US006857356B2

(12) United States Patent
van Haag et al.

(10) Patent No.: US 6,857,356 B2
(45) Date of Patent: Feb. 22, 2005

(54) CALENDER AND PROCESS FOR OPERATING A CALENDAR

(75) Inventors: Rolf van Haag, Kerken (DE); Eva Scheidler, Nattheim (DE); Robert Wolf, Herbrechtingen (DE)

(73) Assignee: Voith Paper Patent GmbH, Heidenheim (DE)

( * ) Notice: Subject to any disclaimer, the term of this patent is extended or adjusted under 35 U.S.C. 154(b) by 122 days.

(21) Appl. No.: 10/192,499

(22) Filed: Jul. 11, 2002

(65) Prior Publication Data

US 2003/0024415 A1 Feb. 6, 2003

(30) Foreign Application Priority Data

Jul. 12, 2001 (DE) ..... 101 33 888

(51) Int. Cl.[7] ..... B30B 11/22

(52) U.S. Cl. ..... 100/35; 100/41; 100/158 R; 100/159; 100/161; 100/168; 264/40.1; 264/175

(58) Field of Search ..... 100/35, 41, 47, 100/155 R, 157, 158 R, 161, 162 R, 162 B, 163 R, 164, 168, 169, 176; 72/10.2, 10.3, 10.4, 172, 248, 247; 264/40.1, 175

(56) References Cited

U.S. PATENT DOCUMENTS

| | | | | |
|---|---|---|---|---|
| 3,044,392 A | | 7/1962 | Minarik | |
| 3,240,148 A | * | 3/1966 | Varga | 100/158 R |
| 4,117,054 A | * | 9/1978 | Salo | 264/40.1 |
| 4,348,952 A | * | 9/1982 | Gooch | 100/158 R |
| 4,516,491 A | | 5/1985 | Winter | |
| 4,596,523 A | * | 6/1986 | Whitehead | 425/367 |
| 5,501,145 A | | 3/1996 | Fromm | |
| 5,961,899 A | * | 10/1999 | Rossetti et al. | 264/40.1 |
| 6,199,476 B1 | * | 3/2001 | Kayser | 100/35 |
| 6,305,280 B1 | | 10/2001 | Beckers | |
| 2002/0060021 A1 | | 5/2002 | Kayser et al. | |

FOREIGN PATENT DOCUMENTS

| | | |
|---|---|---|
| DE | 19601293 | 7/1997 |
| DE | 19815339 | 10/1999 |
| EP | 949378 | 10/1999 |
| EP | 1127977 | 8/2001 |
| WO | 99/25921 | 5/1999 |

OTHER PUBLICATIONS (1) Article by J. R. Parker et al. "Analysis and Control of Calender Barring" Pulp & Paper Canada, vol. 76, No. 10, Oct. 1975, pp. 89–91.

Article by J. B. A. Epton et al. "Glättwerk–Barring und Naβpressenvibration" Wochenblatt Für Papierfabrikation 17, 1981, pp. 616–622.

Article by J. R. Parker "Investigation of Vibrations and Disturbances" Pulp & Paper Canada, vol. 80, No. 7, Jul. 1979, pp. 39–43.

(4) Article by L. Huser et al. "Selbsterregte Schwingungen in Mehrwalzen–Glaättwerken" Escher Wyss Mitteilungen 1/2, 1980, pp. 200–207.

(List continued on next page.)

*Primary Examiner*—Allen Ostrager
*Assistant Examiner*—Jimmy T Nguyen
(74) *Attorney, Agent, or Firm*—Greenblum & Bernstein, P.L.C.

(57) ABSTRACT

Calender including a roll stack having a plurality of rolls that rest against one another in a press direction. At least one of the rolls has an elastic surface. A vibration recording device determines in an uninterrupted manner a vibration of at least one of the rolls. A mechanism displaces the at least one roll crosswise to the press direction based on the vibration. The process includes determining in an uninterrupted manner a vibration of at least one of the rolls and displacing the at least one roll crosswise to the press direction based on the vibration.

31 Claims, 3 Drawing Sheets

OTHER PUBLICATIONS

Document "Calender Vibration—A Simulation Study and a Cure," Tappi Journal, vol. 52, No. 7, Jul. 1969, pp. 1356 through 1361.

Document "Calender barring on paper machines—practical conclusions and recommendations," Tappi Journal, vol. 58, No. 8, Aug. 1975, pp. 147 through 151.

"Barringbildung am Glattkalander einer Papiermaschine" DAS PAPIER, Nr. 9, 1995, pp. 581–590, XP–001118222.

"Calender barring on paper machines–practical conclusions and recommendations," Tappi Journal, vol. 58, No. 8, Aug. 1975, pp. 147–151.

* cited by examiner

CALENDER AND PROCESS FOR OPERATING A CALENDAR

CROSS-REFERENCE TO RELATED APPLICATIONS

The present application claims priority under 35 U.S.C. §119 of German Patent Application No. 101 33 888.0, filed on Jul. 12, 2001, the disclosure of which is expressly incorporated by reference herein in its entirety.

BACKGROUND OF THE INVENTION

1. Field of the Invention

The invention relates to a process for operating a calender with a roll stack which features two end rolls and in between several middle rolls that rest against one another in a press direction, with at least one roll having an elastic surface. The invention further relates to a calender with a roll stack which features two end rolls and in between several middle rolls, with at least one roll having an elastic surface.

2. Discussion of Background Information

Such calenders are used in particular for glazing paper or cardboard webs. The invention is described below on the basis of the treatment of a paper web. However, it can be used in the same way with other material webs with which similar problems occur.

When glazing a paper web, the paper web is guided through the calender and into nips that are formed between a hard and a soft roll, i.e., a roll with an elastic surface, and is acted upon by increased pressure and, if necessary, also by increased temperature. In calenders of more recent construction type, e.g., the "Janus" calenders, rolls are used that are covered with a plastic coating. It can now be observed that in many cases crosswise stripes occur on the paper web after a certain operating time. As soon as these stripes become visible, the paper web is unusable and forms waste. The reasons for this so-called barring formation has not yet been conclusively determined. However, it is assumed that they are the effects of a vibration phenomenon. However, vibrations are virtually unavoidable in a calender.

In the barring formation, the elastic surface of the soft roll is changed. It has not yet been conclusively determined what this change actually entails. The following possibilities are currently assumed: the rolls develop a waviness on the surface, i.e., a hill and valley structure, that the roll becomes polygonal, or that the roll alternately develops zones of differing surface quality, e.g., differing roughness, in the circumferential direction. Regardless of the particular type of change, after the barring formation, periodic stripes appear in the axial direction on the circumference of the roll. Corresponding stripes then appear on the paper web, whereby the paper web is to be considered as waste at the latest by the time the stripes become visible.

When a barring phenomenon occurs, the roll that causes the barring formation has to be removed, reground or finished. The service life of such a roll is therefore limited.

SUMMARY OF THE INVENTION

The invention aims to increase the service life of such a roll.

The invention therefore provides a process of the type mentioned at the outset by determining a vibration with at least one roll in an uninterrupted manner and by implementing a roll displacement crosswise to the press direction depending on the vibration.

Thus, a regulation system is used to prevent the development of barring patterns. As a rule, a barring pattern can be detected on the surface of a roll before this barring pattern becomes impressed in the paper web in the form of crosswise stripes. Therefore, if measures are taken in good time (sooner rather than later) to disrupt a stronger impression of the barring pattern, the service life of the roll can be increased. This is based on considerations which will hereinafter be described.

A roll stack that is formed of several rolls has a plurality of natural frequencies. This not refer to the natural frequencies of the individual rolls, such as, e.g., natural frequencies in bending, but to the natural shapes of vibrations that result from the vibrating roll masses on the spring and damping systems of the interposed plastic coatings of the "soft" rolls. A running calender produces exciter forces, the frequencies of which are composed of the multiple of the roll rotational speeds. These exciter forces can be due to inhomogeneities, anisotropies or geometry errors (out of roundnesses). Fluctuations in paper thickness of the paper web running through the calender can also stimulate the roll stack. A paper web running into the calender is still very rough before the glazing process. In addition, a paper web is never free from basis weight or thickness fluctuations. If these fluctuations are analyzed with the aid of a FFT analysis of their frequencies, as a rule a wide-band noise is determined, which contains all the frequencies. If one of these exciter frequencies meets a natural frequency, the vibration system of the calender responds with enlarged vibration amplitudes. These resonance points cannot be constructively avoided because of the large number of possible exciters and the large number of possible natural shapes of vibrations. As a rule, the vibration system is also so greatly damped and the exciter forces are so small that the resulting vibration movements are not directly disruptive. Over a more or less extensive period of time, however, these vibration movements are impressed into the plastic coatings of the elastic rolls.

The integral multiple of the roll rotational frequency nearest to the natural frequency is usually impressed into the roll as a pattern. This results in a regeneration of the vibration. The vibration amplitudes then increase exponentially. They are expressed on the one hand in an increased noise level (up to more than 120 dB(A)), and on the other in periodic fluctuations in thickness of the paper web running through. Varying periods of time are observed in practice in which these regeneration phenomena develop, which are expressed in barrings. Some days or weeks usually pass until this phenomenon has grown so significantly that it disrupts the production process.

Measures can be taken at a relatively early stage to prevent or disrupt the formation of barring patterns on the elastic rolls. To this end only vibrations are determined. With a certain amount of experience or with measures specified below, the regeneration behavior of the roll stack or of even the whole calender can be changed so that a development of barring patterns which has started at least does not further increase. As a rule, a regression of the barring pattern can be achieved with a targeted regulation that reacts to the vibrations. Although it is hereby accepted that barring patterns with other frequencies will develop again, since the regulation works continuously, the roll displacement can also be made at several times one after another, whereby the time intervals between two adjustments of the roll displacement are determined by the vibration condition of the calender.

The roll displacement is preferably made when the vibration contains a frequency that corresponds to one of several preset frequencies. As a rule, the vibration that is determined will contain a broad spectrum of frequencies that have different causes. The influence of the paper web should not be disregarded here. After leaving the paper machine, the paper web has a certain surface roughness and thus provides a stimulus for the vibrations. However, only a few of the frequencies are critical. It is therefore sufficient to make a frequency analysis of the vibration and to see whether it contains the critical frequencies. Since these critical frequencies are preset, they are termed "preset frequencies."

A displacement is preferably made when the portion with the frequency exceeds a predetermined amplitude. Even critical frequencies are not disruptive from the start in every case. When they occur with small amplitude they are merely a warning signal. A certain tolerance threshold can be provided and a displacement made only when a predetermined amplitude is exceeded. Although this runs the risk of barring patterns developing, the operation of the calender is changed less frequently, keeping further possibilities for disruption to a minimum.

A wavelength that corresponds to an integral fraction of the circumference of a roll preferably exists for each preset frequency. When the barring patterns on the surface of a roll are analyzed, it is established that this is a wave pattern in which the wavelength corresponds to an integral fraction of the roll circumference. It will not be possible to observe barring patterns with other wavelengths, because with these other barring patterns a transforming would have to result continuously which prevents a final development of such a barring pattern. In the case of barring patterns in which an integral multiple of the wavelength yields exactly the circumference of the roll, this erasing does not occur. However, a certain frequency can be assigned to each of these barring patterns, which frequency also depends, e.g., on the circumferential speed of the relevant roll. In this way, it is relatively simple to calculate the preset frequencies.

The vibration is preferably determined at least on each middle roll, and the preset frequencies are restricted to wavelengths that occur on the corresponding roll. This approach has several advantages. For one thing, the vibration that occurs on a roll can be detected directly from this roll with substantially lower damping than on other rolls. The information on the roll vibration is therefore more directly available. For another, a substantially smaller number of preset frequencies has to be taken into consideration. This applies in particular when the rolls of the roll stack feature different circumferences. However, this situation occurs as a rule in particular when one or more rolls with elastic coatings have already been reworked once. In this case, the processing costs are reduced, as only less information needs to be evaluated. The regulation can then be made more quickly.

The roll is preferably displaced by a distance that depends on the wavelength of the frequency. As the wavelength of the barring pattern is known from the determined frequency, this information can now be evaluated and the roll displaced crosswise to the press direction by an amount associated with this wavelength information. It can thus be achieved with certain displacement distances that a development of the barring pattern is reversed. With deviating displacement distances a further development of the barring pattern can at least be checked.

It is particularly preferred here for the roll to be displaced by a distance at which a difference in distance between two nips occurs that is in the range of approximately a quarter to approximately half a wavelength. If a roll displacement were made in which the difference in distance was exactly one wavelength, it would certainly not have a positive effect. In the case of longer differences in distance, the roll would have to be displaced further accordingly, whereby the risk of achieving an unfavorable change in the geometry of the roll stack would have to be taken into account. If instead the displacement is restricted to relatively short differences in distance between a quarter and half a wavelength, the displacement of the roll crosswise to the press direction is correspondingly small, yet the advantageous effect is achieved of the barring patterns receding or at least not becoming more significant.

The roll is preferably displaced by a distance that is in the range of approximately an eighth to approximately a quarter of a wavelength. This applies to middle rolls, for which the roll surface runs through two nips during one revolution. In order to bring about a difference in distance on the surface between two nips of a quarter or half a wavelength, it is then only necessary to displace the roll by half the difference in distance. Then on the one side of the roll the difference in distance is increased by double the roll displacement, while on the other side of the roll it is reduced by double the displacement distance. Therefore, if one wants to change the difference in distance by a quarter of a wavelength, only a displacement movement of an eighth of a wavelength is necessary. The displacement movement is therefore restricted to a length in the range of approximately 10 mm.

The invention also provides a calender of the type mentioned at the outset in that a vibration recording device is arranged on at least one roll, which device is connected to a regulator that is connected to an adjustment drive of at least one roll.

A control loop is thus established that adjusts a roll depending on vibrations that occur on this or another roll. One is therefore no longer dependent on a random adjustment on the principle of trial and error. The rolls do not have to be continuously adjusted either, in order to prevent the vibration development at some operating point. Instead, one checks whether vibrations of a certain type are developing. When such vibrations develop, the regulator intervenes and adjusts the roll via the adjustment drive.

It is preferred that the vibration recording device is connected to a frequency analysis device. The frequency analysis device determines which frequencies are contained in the vibration. As explained above, not all frequencies are critical. The activity of the regulator can therefore be restricted to certain frequencies.

The vibration recording device preferably features several vibration recorders that are aligned in different directions. The information to be evaluated can thus be condensed. Vibrations that, e.g., have their main vibration direction parallel to the axial direction of the rolls, are less critical for the barring formation than vibrations that are oriented radially to the roll axis.

The vibration recording device is preferably arranged at least on each middle roll. The vibrations are therefore determined on each middle roll. This has the advantage that for one thing the vibration of each middle roll can be determined on the middle roll itself, so that it has not been damped or even falsified by a transmission path via other rolls. Furthermore, the evaluation can be restricted to the critical frequencies which can occur at the specific roll. Finally, when the vibration is determined individually on each roll, at least on each middle roll, a step can be taken in a more targeted manner to prevent the development of a barring pattern on each roll.

At least the middle rolls are preferably arranged on levers and the adjustment drive acts on the lever. This is a relatively simple measure to effect the displacement of the respective roll perpendicular or cross-wise to the press direction.

There are a number of possibilities for the embodiment of the adjustment drive.

It is provided in a preferred embodiment for the adjustment drive to feature an eccentric bushing in which a point of support of the lever is arranged. By a rotation of the eccentric bushing about an axis that runs parallel to the roll axis, a point of support of the lever, e.g., the center of rotation, can be changed relative to the press direction.

It is provided in an alternative embodiment for the lever to be supported in a sliding block that features a linear drive. The linear drive first causes a translatory displacement of the sliding block, e.g., with the aid of a threaded spindle. The sliding block thereby drives the lever such that the roll can again ultimately be displaced perpendicularly to the press direction.

Finally, it can also be provided that the lever is embodied in a device that is adjustable in length. Such an embodiment can be realized, e.g., by a telescopic or prismatic guide, in which two components of the lever can be displaced relative to one another.

In a further alternative embodiment there can be provided a hinged connection with a tilting gearing to be provided between the lever and a bearing housing. Displacement movements of the roll can thereby be adjusted relatively precisely.

The invention provides a process for operating a calender including a roll stack having a plurality of rolls that rest against one another in a press direction, at least one of the rolls having an elastic surface, the process including determining in an uninterrupted manner a vibration of at least one of the rolls and displacing the at least one roll crosswise to the press direction based on the vibration.

The plurality of rolls may comprise two end rolls and several middle rolls. The process may further comprise determining a frequency of the vibration. The process may further comprise comparing the frequency to one of several preset frequencies. The process may further comprise analyzing a portion of the frequency. The displacing may comprise displacing the at least one roll when the portion of the frequency exceeds a predetermined amplitude. The process may further comprise determining a wavelength of the vibration. The wavelength may correspond to an integral fraction of a circumference of the at least one roll. The process may further comprise comparing the wavelength to a present frequency. The determining may comprise determining the vibration for each middle roll. The displacing may comprise moving the at least one roll by a distance that depends on a wavelength of a frequency of the vibration. The distance may be in the range of approximately a quarter to approximately half a wavelength. The distance may be in the range of approximately an eighth to approximately a quarter of a wavelength.

The invention also provides a calender which includes a roll stack having a plurality of rolls that rest against one another in a press direction, at least one of the rolls having an elastic surface, a vibration recording device, and a mechanism that displaces the at least one roll crosswise to the press direction based on the vibration.

The plurality of rolls may comprise two end rolls and several middle rolls. The vibration recording device may be arranged on at least one of the rolls. The vibration recording device may be connected to a regulator. The regulator may be connected to the mechanism. The mechanism may comprise an adjustment drive. The vibration recording device may be connected to a frequency analysis device. The vibration recording device may include several vibration recorders that are aligned in different directions. The vibration recording device may be arranged on at least each middle roll. At least some of the rolls may comprise middle rolls which are each arranged on levers. The levers may be movable via adjustment drives. The mechanism may comprise an eccentric bushing. The at least one roll may be mounted to levers which are supported in sliding blocks. Each lever may be coupled to a linear drive. The at least one roll may be mounted to levers which are adjustable in length. The at least one roll may be mounted to levers which include a hinged connection and a tilting gearing. The tilting gearing may be arranged between each lever and a bearing housing. The vibration recording device may determine in an uninterrupted manner a vibration of at least one of the rolls.

The instant application expressly incorporates by reference in their entireties, the disclosures of commonly owned and concurrently filed herewith applications U.S. patent application Ser. No. 10/192,529 entitled "PROCESS FOR OPERATING A CALENDER"; U.S. patent application Ser. No. 10/192,530 entitled "CALENDER AND PROCESS FOR ARRANGING ROLLS IN A ROLL STACK OF A CALENDER"; and U.S. patent application Ser. No. 10/192,554 entitled "PROCESS FOR OPERATING A CALENDER".

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
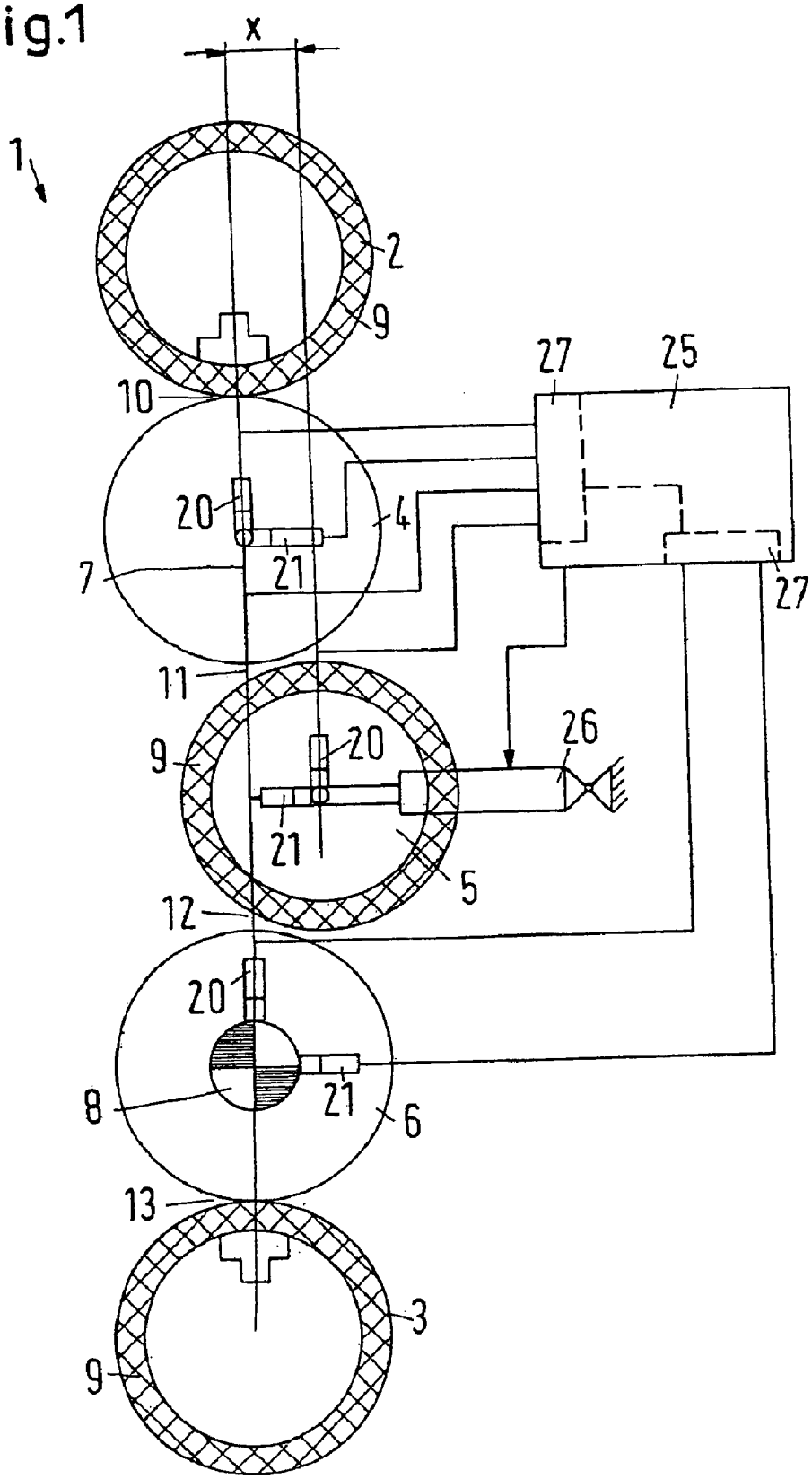
FIG. 1 shows a diagrammatic side view representation of a calender.

FIG. 1 shows a diagrammatic representation of a calender 1 with two end rolls 2, 3 that are embodied as load-deflection rolls, and three middle rolls 4–6 that together form a roll stack. The roll stack features a roll plane 7 in which the axes of all rolls 2–6 lie when the rolls 2–6 are arranged exactly one above the other. For the purposes of the following description, the press direction, i.e., the direction in which the rolls 2–6 are pressed against one another, also lies in this roll plane.

Further details of the calender 1 are represented only in diagrammatic form, such as a drive 8, or omitted completely, such as systems for heating individual rolls. However, the two end rolls 2, 3 and the centermost roll 5 feature an elastic coating 9, which is shown with exaggerated thickness.

During the operation of the calender 1, the rolls 2–6 form nips 10–13 in a known manner, through which nips a material web to be treated is guided. All the nips are embodied here as so-called soft nips, since they are formed by one hard and one soft roll.

Figure 2:
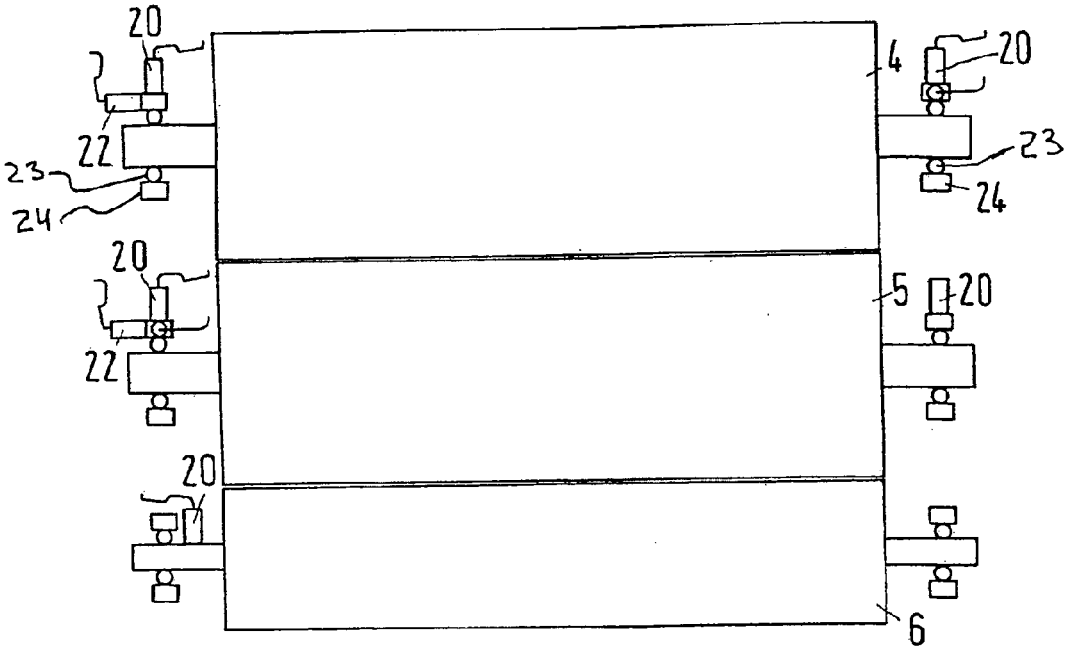
FIG. 2 shows a segment of the representation of the calender according to FIG. 1 from the front.

Vibration recorders 20, 21, 22 (see also FIG. 2) are arranged on the intermediate rolls, which vibration recorders determine a vibration of the middle rolls 4–6. The vibration recorders 20–22 are preferably arranged on the bearings 23, or more precisely on the bearing housings 24. The vibration recorders 20 determine vibrations in the vertical direction, the vibration recorders 21 determine vibrations perpendicular to the roll plane, i.e., the plane through the middle axes of the (undisplaced) rolls 2–6, and the vibration recorders 22 determine vibrations in the axial direction. In general it can be said that the vibration recorders 20–22 basically can determine any vibration directions, as long as the directions are substantially orthogonal to one another.

The vibration recorders 20–22 are connected to a regulator 25 that in turn acts on an adjustment drive 26. The regulator 25 also features a frequency analysis device 27 that can be coupled with a comparator (not shown in detail) and a threshold value element. The frequency analysis device 27 determines from the vibrations that are recorded by the vibration recorders 20–22, the amplitude portion that can be attributed respectively to a frequency (or to a narrow frequency range). When the amplitude of a frequency exceeds a predetermined boundary or threshold value, and this frequency can be considered critical because it relates to a wavelength the integral multiple of which corresponds to the circumference of the appropriate roll, the adjustment drive 26 is started in order to adjust the appropriate roll crosswise to the press direction. This is diagrammatically represented in FIG. 1 for the centermost roll 5. However, it is obvious that basically all rolls 2–6 can be adjusted.

It can now be observed that the vibration behavior of the rolls changes after a roll displacement by the distance X. Particularly favorable conditions result when certain limiting conditions are taken into consideration during the displacement movement X, which limiting conditions are explained below on the basis of FIG. 3.

Figure 3:
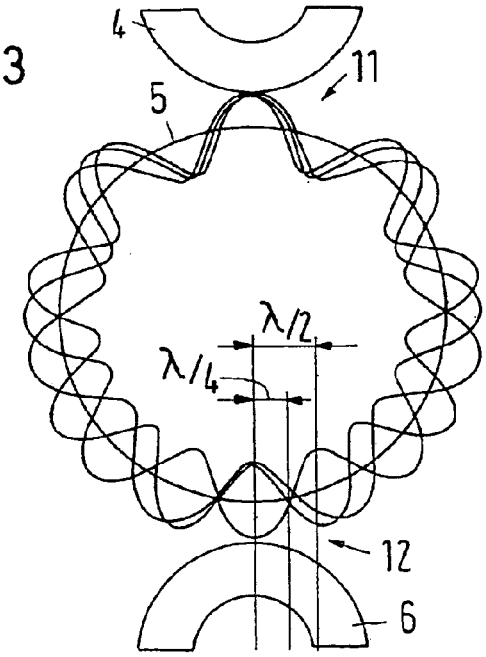
FIG. 3 shows a diagrammatic representation to explain the development of a barring pattern.

FIG. 3 shows the roll 5, the roll 4 located above it, and the roll 6 located below it. Various reference wavinesses are represented with exaggerated amplitudes, namely a waviness in which seven waves run around the circumference of the roll 5, one with eight waves and one with nine waves. The numbers n=7, 8, 9 were chosen for reasons of clarity. In the case of real rolls, a correspondingly higher number of waves develop over the circumference of the roll, e.g., in the range of 30 to 50. In the case of such a high number of waves running around the circumference of the roll 5, it can be assumed in a first approximation that in the case of a small displacement movement of the roll 5 relative to the roll plane 7 that is smaller than a wavelength, the curvature of the roll 5 does not matter.

When the regulator 25 has determined that a critical frequency that was either set beforehand from empirical values or determined by other methods, appears with a predetermined amplitude, it is to be expected that a certain wavelength $\lambda$ is also associated with this frequency, at which wavelength the barring pattern is impressed on the surface of the roll. The roll 5 is then displaced relative to the roll plane 7, i.e., relative to the nips 11, 12, such that the distance between the two nips 11, 12 on the one side is increased by half a wavelength $\lambda/2$ and on the other side is reduced by this half a wavelength $\lambda/2$. To this end only a displacement X is necessary, where $X=\lambda/4$, because this results in the desired difference in distance between the two nips 11, 12.

With a difference in distance of $\lambda/2$, no strain occurs at the points on the circumference of the roll 5 which were previously heavily strained and where accordingly wave valleys have formed. Instead, this strain occurs at the wave hills, where such strain has hitherto been missing. The strains result from the vibration movements of the three rolls 4, 5, 6 relative to one another. It can thus be achieved through a difference in distance of $\lambda/2$ that a barring pattern already developed regresses again and disappears in the course of time. The risk is thereby run of a different barring pattern developing, the wavelength of which is near to the wavelength of the original barring pattern. Thus, when the original barring pattern had a wavelength of U/n, where U is the circumference of the roll 5, then the new barring pattern possibly has a wavelength of $U/(n\pm1)$. However, it will take some time before such a new barring pattern is impressed to the extent that it becomes disruptive.

A reduction in the regenerative coupling can already be achieved with a phase displacement between two nips 11, 12 of $X=\lambda/4$. Since a reduction or elimination of the disruption is to be achieved both for the regenerative coupling through the material web and also for the regenerative coupling via the roll surface, a displacement should be selected in which both the phase displacement for the paper and the phase displacement for the roll is in the range of $\lambda/4$ to $\lambda/2$. A phase displacement by the regulator 25 is aimed at here that is closer to $\lambda/2$. The danger that is associated with a phase displacement of $\lambda/2$, namely that after the elimination of the original pattern, a new pattern will be impressed, is counteracted by the adjustment. As soon as impression frequencies with predetermined amplitudes are perceptible with the aid of the vibration measurement, whereby these amplitudes can also be relatively small, a new roll displacement is determined and adjusted, which in turn effects an elimination. The time intervals between two adjustments of the roll displacement are accordingly determined through the vibration condition of the calender 1.

FIG. 4*a*–4*d* show various possibilities for effecting the roll displacement. The explanation is made in all cases on the basis of the example of the middle roll 5, which is supported in a bearing housing 30 that is located at the front end of a lever 31.

Figure 4A:
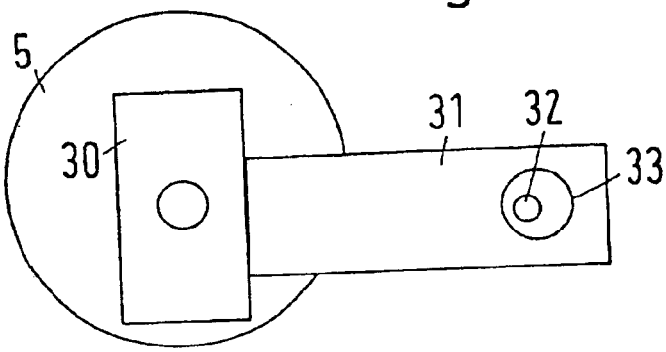
FIGS. 4*a*–4*d* show various embodiments for displacing a roll.

In the exemplary embodiment according to FIG. 4*a*, the lever 31 is supported with a point of support 32 in an eccentric bushing 33. When the eccentric bushing 33 is rotated, the position of the roll 5 is changed in the horizontal direction.

Figure 4B:
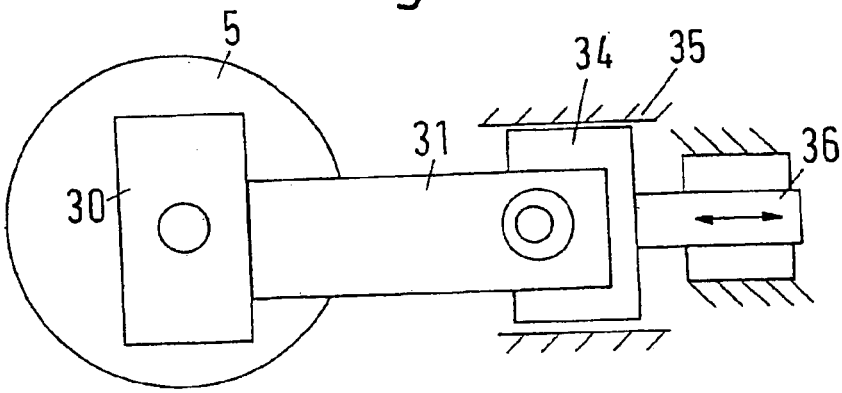

In the exemplary embodiment according to FIG. 4*b* the lever 31 is supported in a sliding block 34 that can be moved in a housing 35 by a linear drive 36, which is shown only in diagrammatic form. The linear drive 36 can be implemented, e.g., as a threaded spindle. Relatively precise adjustment movements are also possible with a threaded spindle.

Figure 4C:
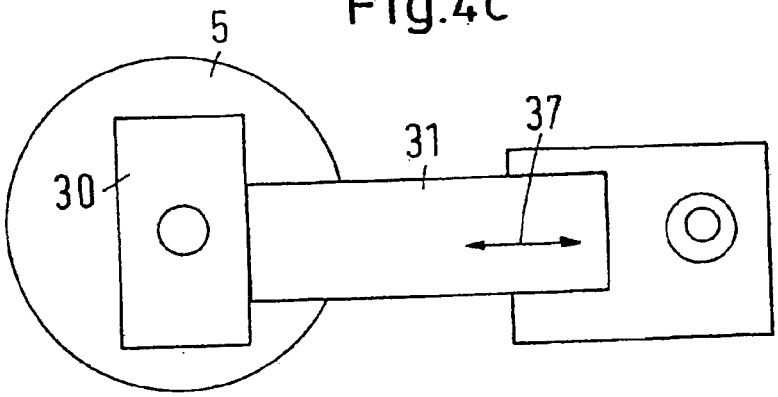

In the exemplary embodiment according to FIG. 4*c*, the lever 31 is embodied as adjustable in length, which is represented by a double arrow 37. The lever 31 can feature, e.g., a telescopic guide or a prismatic guide. The two parts of the lever that can be displaced relative to one anther can likewise be driven via a threaded spindle (not shown in detail).

Figure 4D:
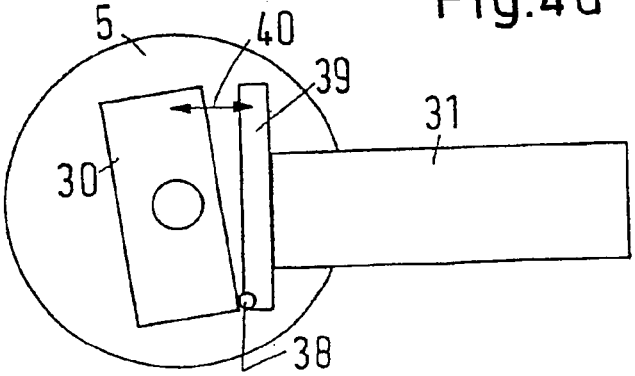

In the exemplary embodiment according to FIG. 4*d*, the bearing housing 30 is connected to the lever 31 via a swivel joint 38. The swivel joint 38 is arranged at the lower end of a fastening plate 39, which in turn is attached to the lever 31. Of course, an attachment at the upper end is also possible. A tilting gearing 40 shown in diagrammatic form is provided to tilt the bearing housing 30 relative to the lever 31 by a defined amount.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for operating a calender including a roll stack having a plurality of rolls that rest against one another in a press direction, at least one of the rolls having an elastic surface, the process comprising:

determining in an uninterrupted manner a frequency of vibration of at least one of the rolls; and displacing the at least one roll having the elastic surface crosswise to the press direction based on the frequency of vibration.

2. The process of claim 1, wherein the plurality of rolls comprise two end rolls and several middle rolls.

3. The process of claim 1, further comprising comparing the frequency of vibration to one of several preset frequencies.

4. The process of claim 1, further comprising analyzing a portion of the frequency of vibration.

5. The process of claim 4, wherein the displacing comprises displacing the at least one roll having the elastic surface when the portion of the frequency of vibration exceeds a predetermined amplitude.

6. The process of claim 1, further comprising determining a wavelength of the frequency of vibration.

7. The process of claim 6, wherein the wavelength corresponds to an integral fraction of a circumference of the at least one roll having the elastic surface.

8. The process of claim 7, further comprising comparing the wavelength to a present frequency.

9. The process of claim 1, wherein the determining comprises determining the frequency of vibration for each middle roll.

10. The process of claim 1, wherein the displacing comprises moving the at least one roll having the elastic surface by a distance that depends on a wavelength of the frequency of vibration.

11. The process of claim 10, wherein the distance is in the range of approximately a quarter to approximately half a wavelength.

12. The process of claim 10, wherein the distance is in the range of approximately an eighth to approximately a quarter of a wavelength.

13. A calender comprising:

a roll stack having a plurality of rolls that rest against one another in a press direction;

at least one of the rolls having an elastic surface;

at least one vibration recording device which is at least one of:

arranged on at least one of the rolls; and connected to at least one of the rolls; and a mechanism that displaces at least one of the rolls having the elastic surface crosswise to the press direction based on a vibration.

14. The calender of claim 13, wherein the plurality of rolls comprise two end rolls and several middle rolls.

15. The calender of claim 13, wherein the at least one vibration recording device comprises a plurality of vibration recording devices in which each vibration recording device is arranged on one of the rolls.

16. The calender of claim 15, wherein the at least one vibration recording device is connected to a regulator.

17. The calender of claim 16, wherein the regulator is connected to the mechanism.

18. The calender of claim 17, wherein the mechanism comprises an adjustment drive.

19. The calender of claim 13, wherein the at least one vibration recording device is connected to a frequency analysis device.

20. The calender of claim 13, wherein at least one of the rolls comprises a middle roll and wherein the at least one vibration recording device is arranged on the middle roll.

21. The calender of claim 13, wherein at least some of the rolls comprise middle rolls which are each arranged on levers.

22. The calender of claim 21, wherein the levers are movable via adjustment drives.

23. The calender of claim 13, wherein some of the rolls are mounted to levers which are supported in sliding blocks.

24. The calender of claim 23, wherein each lever is coupled to a linear drive.

25. The calender of claim 13, wherein some of the rolls are mounted to levers which are adjustable in length.

26. The calender of claim 13, wherein some of the rolls are mounted to levers which include a hinge connection and a tilting gearing.

27. The calender of claim 26, wherein the tilting gearing is arranged between each lever and a bearing housing.

28. The calender of claim 13, wherein the vibration recording device determines in an uninterrupted manner a vibration of at least one of the rolls.

29. A calender comprising:

a roll stack having a plurality of rolls that rest against one another in a press direction;

at least one of the rolls having an elastic surface;

a vibration recording device; and a mechanism that displaces the at least one roll crosswise to the press direction based on a vibration, wherein the vibration recording device includes several vibration recorders that are aligned in different directions.

30. A calender comprising:

a roll stack having a plurality of rolls that rest against one another in a press direction;

at least one of the rolls having an elastic surface;

a vibration recording device; and a mechanism that displaces the at least one roll crosswise to the press direction based on a vibration, wherein the mechanism comprises an eccentric bushing.

31. A process for operating a calender including a roll stack having a plurality of rolls that rest against one another in a press direction, at least one of the rolls having an elastic surface, the process comprising:

determining a vibration of at least one of the rolls;

analyzing a frequency of the vibration; and displacing at least one of the rolls having the elastic surface crosswise to the press direction based on the analyzing.

* * * * *